United States Patent [19]

Nickolay

[11] Patent Number: 4,570,433

[45] Date of Patent: Feb. 18, 1986

[54] YARN END BLOWING NOZZLE

[75] Inventor: Helmut Nickolay, Göppingen, Fed. Rep. of Germany

[73] Assignee: Zinser Textilmaschinen GmbH, Ebersbach, Fed. Rep. of Germany

[21] Appl. No.: 602,325

[22] Filed: Apr. 20, 1984

[30] Foreign Application Priority Data

Apr. 20, 1983 [DE] Fed. Rep. of Germany ..... 3314278

[51] Int. Cl.[4] ..... D01H 13/00; D01H 15/00; B65H 54/22; B65H 54/86

[52] U.S. Cl. ..... 57/305; 57/261; 57/304; 242/35.6 E

[58] Field of Search ..... 57/261, 279, 304, 305; 242/35.6 E

[56] References Cited

U.S. PATENT DOCUMENTS

| | | | |
|---|---|---|---|
| 3,236,464 | 2/1966 | Wey | 242/35.6 E X |
| 3,464,640 | 9/1969 | Kupper | 242/35.6 E |
| 3,559,904 | 2/1971 | Raasch | 242/35.6 E |
| 3,637,148 | 1/1972 | Kupper | 242/35.6 E |
| 3,868,813 | 3/1975 | Vignon | 57/305 |
| 4,009,840 | 3/1977 | Muller | 242/35.6 E |
| 4,132,057 | 1/1979 | Weiss et al. | 57/35.6 E X |

FOREIGN PATENT DOCUMENTS

| | | |
|---|---|---|
| 2423493 | 11/1975 | Fed. Rep. of Germany . |
| 2543767 | 4/1977 | Fed. Rep. of Germany . |

*Primary Examiner*—John Petrakes

*Attorney, Agent, or Firm*—Karl F. Ross; Herbert Dubno

[57] ABSTRACT

A nozzle for the pneumatic release of a broken yarn end in a spinning or twisting frame has a plurality of mutually parallel closely spaced passages trained at an angle to the yarn package so that the individual jets in closely spaced relationship are collectively effective to liberate the broken yarn end and enable it to be captured by a suction hood.

9 Claims, 3 Drawing Figures

YARN END BLOWING NOZZLE

FIELD OF THE INVENTION

My present invention relates to a yarn end blowing nozzle for the pneumatic removal of a broken yarn end from the frustoconical region of a bobbin or other yarn package (coiled-yarn body) on a textile machine.

BACKGROUND OF THE INVENTION

In textile machinery, broken yarn ends which hug the yarn package or bobbin can pose a problem and, for example, in German Patent Document - Open Application DE-OS 25 43 767, a method of an apparatus for the releasing and evacuation of such broken yarn ends is described.

In this system, a suction device is disposed axially above the bobbin and the broken yarn end is extracted from the package surface by a blast of compressed air generated by two nozzles trained with different inclinations against the spindle and offset about the periphery thereof. The nozzle orifices are located at a considerable distance from one another generally on a fork which passes at least to a significant extent around the bobbin.

For various reasons this device has proved to be awkward to utilize and has presented problems largely because of the fork construction.

OBJECTS OF THE INVENTION

It is the principal object of the present invention to provide an improved yarn end removal system whereby these disadvantages can be obviated.

Another object of this invention is to provide a yarn end removal system having an improved nozzle which is of simpler construction but greater effectiveness for the pneumatic release of broken yarn than has heretofore been the case.

SUMMARY OF THE INVENTION

These objects and others which may become apparent hereinafter are attained, in accordance with the invention, by providing the yarn end evacuation system with a nozzle for releasing the yarn end from the package so that it can be drawn into the suction hood. The releasing nozzle comprises a blade-shaped member which can extend radially toward the bobbin, can be mounted on the ring rail or the bobbin rail and comprises a plurality of closely spaced mutually parallel passages in a row, whose orifices are trained at an inclination to the spindle and are directed against the bobbin to lift a broken yarn end from the package on the bobbin into the suction hood.

Because the passages are closely spaced, i.e. have a spacing which is of the same order of magnitude as the diameter of the orifice, a highly simplified construction of the nozzle is possible with nevertheless a more effective extraction of the broken yarn end from the package. Preferably the nozzle orifices are trained upwardly and inwardly against the yarn package at least in the region of a frustoconical convergence thereof. The closely spaced passages form closely spaced jets each of which is substantially cylindrical or in the form of a pencil of air which individually impinges upon the yarn and, by contrast with a slot-like nozzle or passage, more effectively lifts the yarn end therefrom.

While I am not certain as to why the minimum of two and a maximum of five such passages acts in this superior fashion by contrast with a slot extending over substantially the same length as such a row, apparently each individual jet contributes to the effectiveness of the next jet in the lifting action while more distally spaced orifices and slot-like orifices do not have mutual interaction and may impart or produce a laminar flow which is incapable of releasing yarn ends in some cases.

According to a feature of the invention, the passage and orifice diameters are less than 2.5 millimeters while the spacing of the passage from one another (center to center) is less than twice the diameter.

The passages can lie in a straight line row or in a row along a curved line or arc and, as noted, the preferred number of passages for the nozzle is between two and five. The inclination of these passages to the axes of the bobbin and hence to the yarn package can range between 15° and 40°.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
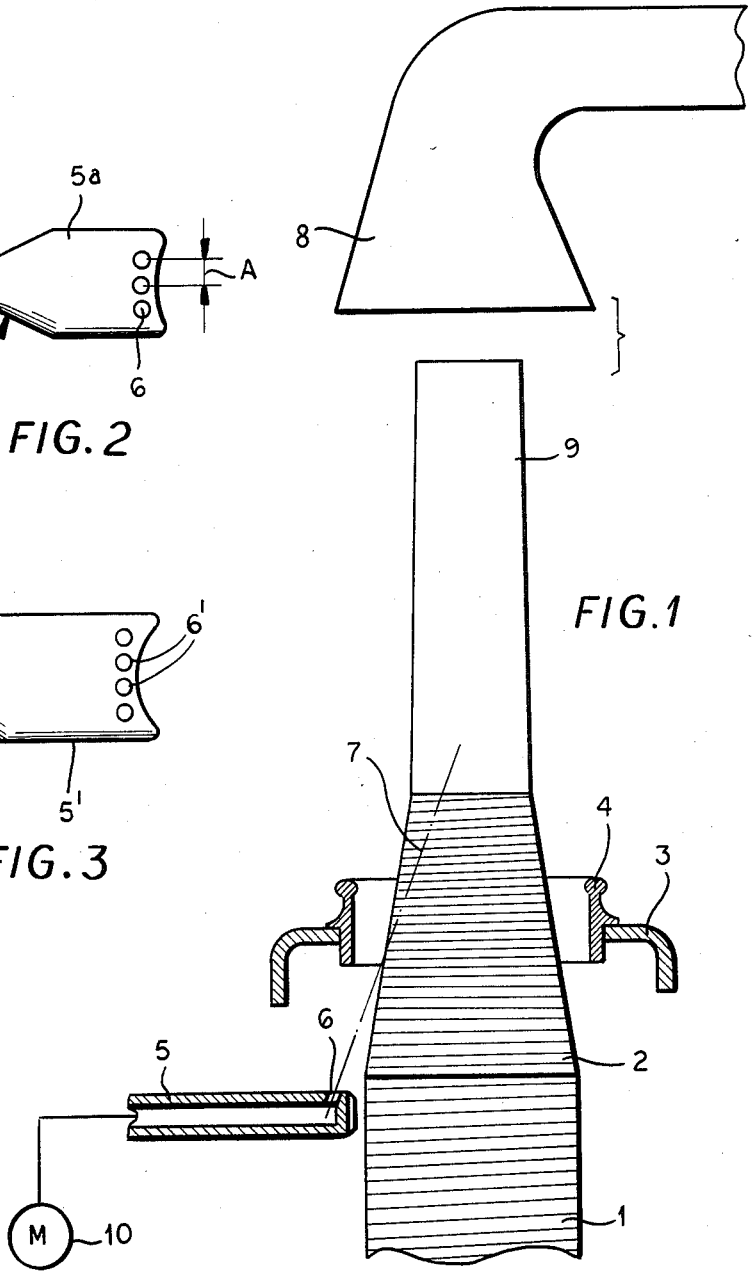
FIG. 1 is a fragmentary vertical section in highly diagrammatic form, illustrating a portion of a ring spinning frame provided with a pneumatic yarn end recovery system according to the invention.

While a ring spinning frame has been represented diagrammatically in FIG. 1 for illustration purposes, it should be assured that the invention is applicable to any textile machine, e.g. for spinning, twisting or twining of one or more yarns, in which a broken yarn end is to be recovered from a yarn package. In the embodiments illustrated, the yarn package 1 of a bobbin is formed on a sleeve or core 9 which can be mounted upon the spindle (not shown) and has a frustoconical portion 2. The textile machine illustrated is of the ring spinning or ring twisting type and has a ring rail 3 carrying a ring 4 upon which a traveler can move as is conventional in the art, the whorl driving the spindle, the means for effecting relative displacement by the bobbin rail and the ring rail, and associated parts of the spinning or twisting machine have not been shown. Below the ring rail 3 and, if desired, mounted thereon or upon some other portion of the spinning frame, is a yarn end releasing nozzle 5 which comprises a blade 5*a* which is flat and lies in a horizontal plane perpendicular to the axis of the spindle. The blade also extends radially of the spindle.

The nozzle is formed with a plurality of mutually parallel passages 6 openings and the upper surfaces at orifices having their axes 7 inclined at the frustoconical portion 2 of the yarn package, the angle of inclination between the axes 7 and hence the respective jets of compressed air, being 15° to 40° with respect to the spindle axis and preferably between 15° and 30°. An air compressor represented at 10 supplies this nozzle.

Above the upper end of the bobbin a suction hood or bell 8 is provided and pneumatically receives the broken yarn end released from the yarn package.

Figure 2:
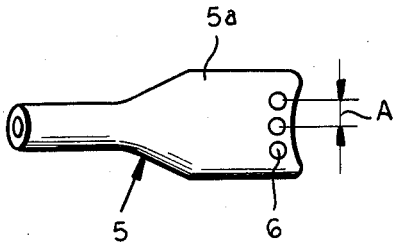
FIG. 2 is a plan view of the nozzle of FIG. 1.
Figure 3:
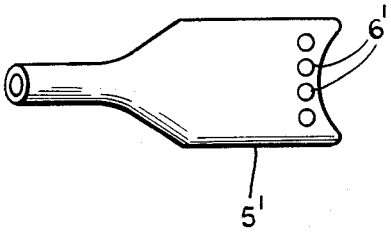
FIG. 3 is a plan view of a nozzle representing an alternative to the construction in FIG. 1.

As can be seen from FIG. 2, the passages 6 lie in a row along a curved line or arc as contrasted with the passages 6′ of the nozzle 5′ which lie along a straight line in FIG. 3. In both cases the diameter of the passage 6 or 6′ can be less than 2.5 millimeters while the spacing A between successive passages should be less than twice the diameter.

Even with this simple construction of the nozzle which does not extend around the bobbin to any significant extent, a highly efficient release of a broken yarn end and entrainment thereof to the receiving unit such as the suction hood 8 is assured and the nozzle takes up little space.

I claim:

1. In a textile machine having a yarn end releasing nozzle for the pneumatic release of yarn end from a yarn package, the improvement wherein said nozzle is flat, reaches toward said yarn package at one side, and is formed along an edge juxtaposed with said package with a plurality of closely spaced mutually parallel passages training respective jets of air at an inclination against said package, said passages having a spacing less than twice the passage diameter.

2. The improvement defined in claim 1 wherein said passages each have a diameter less than 2.5 millimeters.

3. The improvement defined in claim 2 wherein said passages are disposed in a row along a straight line.

4. The improvement defined in claim 2 wherein said nozzle is provided with two to five such passages.

5. The improvement defined in claim 2 wherein said passages are inclined to an axis of said package at an angle between substantially 15° to 40°.

6. The improvement defined in claim 1 wherein said passages are disposed in a row along a curved line.

7. A textile machine comprising:

means having a bobbin forming a yarn package with an axis;

a yarn end suction hood opening toward said bobbin at one axial end thereof for receiving a broken yarn end released from said package; and a nozzle adapted to be supplied with compressed air for releasing said yarn end from said package, said nozzle having a flat blade reaching toward said package and lying in a plane perpendicular to said axis, said blade being formed along an edge thereof with a row of mutually parallel passages training respective jets of air to said end of said package at an inclination of 15° to 40° to said axis, said passages having a spacing of the same order of magnitude as their diameters.

8. The textile machine defined in claim 7 wherein said passages have diameters of less than 2.5 millimeters and center to center spacing of less than twice their diameters.

9. The textile machine defined in claim 8 wherein said nozzle is provided with two to five such passages.

* * * * *